US008333376B2

(12) United States Patent
Nireki

(10) Patent No.: US 8,333,376 B2
(45) Date of Patent: Dec. 18, 2012

(54) PAPER HANDLING APPARATUS HAVING FIRST AND SECOND SENSORS

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 124 days.

(21) Appl. No.: 12/864,460

(22) PCT Filed: Jan. 23, 2009

(86) PCT No.: PCT/JP2009/051127

§ 371 (c)(1),
(2), (4) Date: Jul. 23, 2010

(87) PCT Pub. No.: WO2009/093715

PCT Pub. Date: Jul. 30, 2009

(65) Prior Publication Data

US 2010/0295242 A1 Nov. 25, 2010

(30) Foreign Application Priority Data

Jan. 25, 2008 (JP) ..... 2008-015304

(51) Int. Cl.
*B65H 7/02* (2006.01)

(52) U.S. Cl. ..... 271/265.02

(58) Field of Classification Search ..... 271/165.01, 271/265.02; 194/202, 203, 206, 207, 212, 194/302; 209/534; 250/559.01, 559.11
See application file for complete search history.

(56) References Cited

U.S. PATENT DOCUMENTS

| | | | | |
|---|---|---|---|---|
| 4,470,496 | A * | 9/1984 | Steiner | 194/200 |
| 6,044,952 | A * | 4/2000 | Haggerty et al. | 194/207 |
| 6,782,987 | B1 * | 8/2004 | Abe et al. | 194/207 |
| 2002/0025065 | A1 * | 2/2002 | Yamamoto | 382/135 |
| 2005/0023106 | A1 * | 2/2005 | Abe et al. | 194/207 |
| 2005/0045448 | A1 * | 3/2005 | Sugano et al. | 194/207 |
| 2005/0241909 | A1 * | 11/2005 | Mazur et al. | 194/207 |
| 2006/0054454 | A1 * | 3/2006 | Oh | 194/207 |

FOREIGN PATENT DOCUMENTS

| | | | |
|---|---|---|---|
| JP | 59 17692 | | 1/1984 |
| JP | 59 106090 | | 6/1984 |
| JP | 5 54232 | | 3/1993 |
| JP | 05054232 | A * | 3/1993 |
| JP | 3320806 | | 9/2002 |
| JP | 2003 151008 | | 5/2003 |
| JP | 3756548 | | 3/2006 |

* cited by examiner

*Primary Examiner* — Jeremy R Severson
(74) *Attorney, Agent, or Firm* — Lexyoume IP Meister, PLLC.

(57) ABSTRACT

When individual light emitting diodes of respectively-juxtaposed optical sensors are simultaneously caused to emit light, individual light receiving transistors therefor may be subjected to influences of the light from other light emitting diodes. Therefore, a paper sheet processing apparatus which can read an identification object accurately is provided. The bill processing apparatus (1) includes: a first sensor (8) having a first light emitting part (8*a*) for irradiating the identification object with light and a first light receiving part (8*b*) for receiving the light from the first light emitting part (8*a*), and a second sensor (88) having a second light emitting part (88*a*) for irradiating light in a direction different from that of the first light emitting part (8*a*) and a second light receiving part (88*b*) for receiving the light from the second light emitting part (88*a*).

10 Claims, 11 Drawing Sheets

PAPER HANDLING APPARATUS HAVING FIRST AND SECOND SENSORS

FIELD OF THE INVENTION

The present invention relates to a paper sheet processing apparatus (or paper handling apparatus) which is capable of performing an authenticity judgment for bills, cards, coupon tickets, and so on (hereafter collectively referred to as "paper sheet").

BACKGROUND ART

In general, a bill processing apparatus, which is one of the embodiments of the paper sheet processing apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid.

Recently, it is also seen that a coupon ticket or the like having an equivalent economic value to that of a bill is issued in a game hall and processed by a bill processing apparatus which handles a regular bill. As such a coupon ticket, what has a bar code printed on a paper sheet (thermal paper) formed in the same size as that of a specific bill (typically, United States dollar bill) is known (i.e., a coupon ticket with a bar code) and it is possible for a user to be provided with equivalent services to those by the bill when the issued coupon ticket with the bar code is inserted, in the same manner as the bill, into the insertion slot of the bill processing apparatus which processes the bill.

Meanwhile, in such a way of using the bill processing apparatus, it is necessary for the abovementioned bill processing apparatus to be configured to be capable of judging the authenticity of the bill as well as such a bar-coded paper sheet. As such a bill processing apparatus, for example, Patent Document 1 discloses a configuration that a sensor device for reading a bill or a bar-coded paper sheet inserted into a bill insertion slot is installed in a bill traveling route.

This sensor device has optical sensors which are provided alongside a traveling route, and each of the respective optical sensors has a structure in which a light emitting diode and a light receiving transistor are installed in parallel in a case, and is configured to receive a light reflected on the bottom surface and top surface of each bill. Therefore, when the respective light emitting diodes of the optical sensors provided in parallel emit lights simultaneously, there is a concern that each light receiving transistor may be affected by the lights from the other light emitting diodes.

[Patent Reference 1] Japanese patent No. 3320806

DISCLOSURE OF THE INVENTION

Problem to be Solved by the Invention

Then, here, a paper sheet processing apparatus capable of accurately reading a paper sheet serving as an identification object is provided.

Means to Solve the Problem

In the present invention, a paper sheet processing apparatus comprises: a first sensor having a first light emitting part which irradiates an identification object with light and a first light receiving part which receives the light from the first light emitting part, and a second sensor having a second light emitting part which irradiates the identification object with light in a direction of irradiation different from that of the first light emitting part and a second light receiving part which receives the light from the second light emitting part. Further features of the present invention, its nature, and various advantages will be more apparent from the accompanying drawings and the following description of the preferred embodiment.

BRIEF DESCRIPTION OF THE DRAWINGS

FIG. 6 is a block diagram showing a configuration of control means for controlling driving of a bill conveyance mechanism, bill reading means, and so on.

DESCRIPTION OF NOTATIONS

Figure 1:
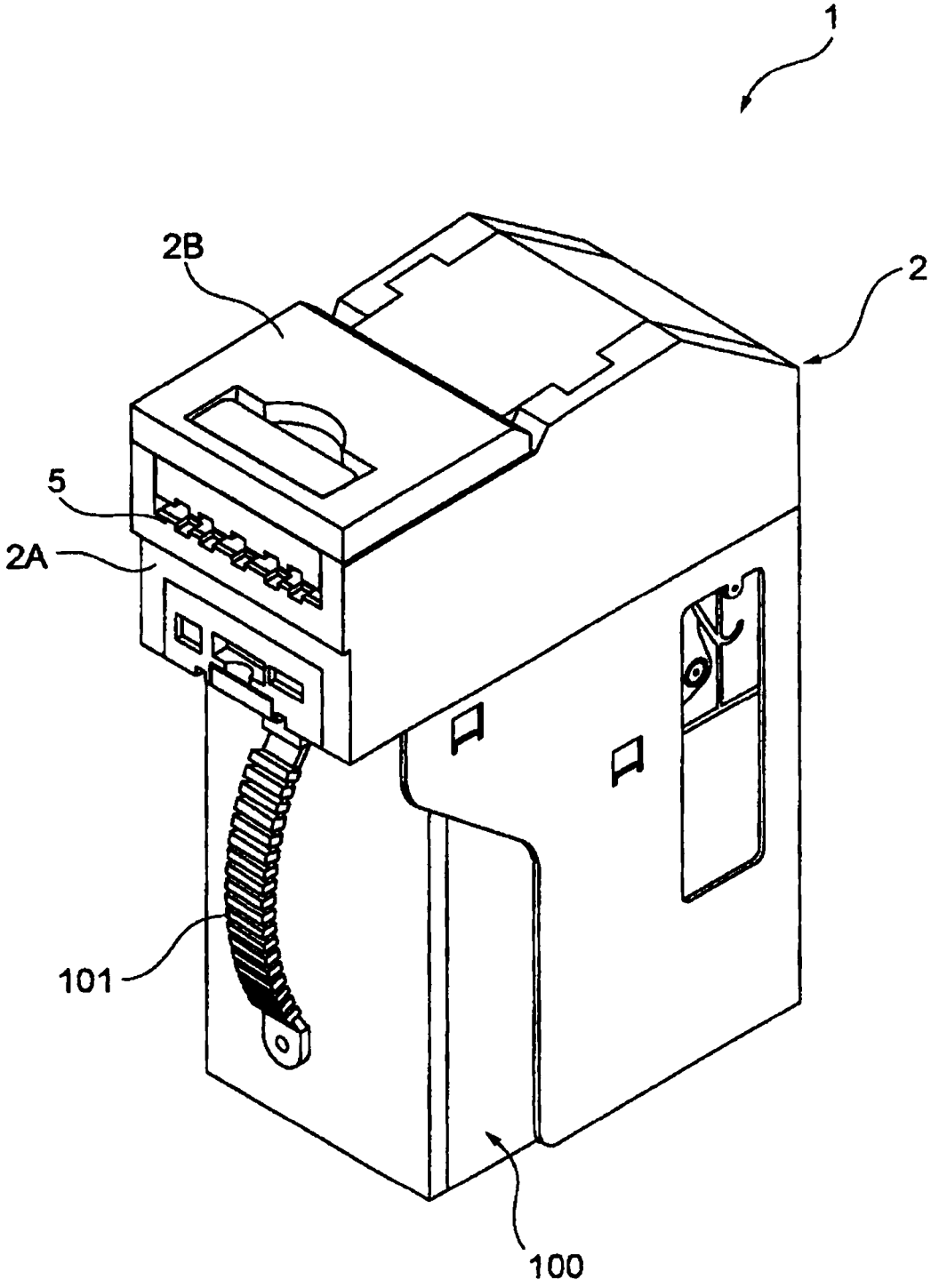
FIG. 1 is a perspective view showing an entire structure to illustrate a configuration of a bill processing apparatus.

1 bill processing apparatus
2 apparatus main body
3 bill traveling route
3A first traveling route
3B second traveling route
5 bill insertion slot
6 bill conveyance mechanism
8 bill reading means (first sensor)
8*a* first light emitting part
8*b* first light receiving part
88 bar code sensor (second sensor)
88*a* second light emitting part
88*b* second light receiving part
10 skew correction mechanism
100 bill housing part
200 control means

BEST MODE FOR CARRYING OUT THE INVENTION

Hereinafter, an embodiment of the present invention will be described with reference to the drawings.

Figure 2:
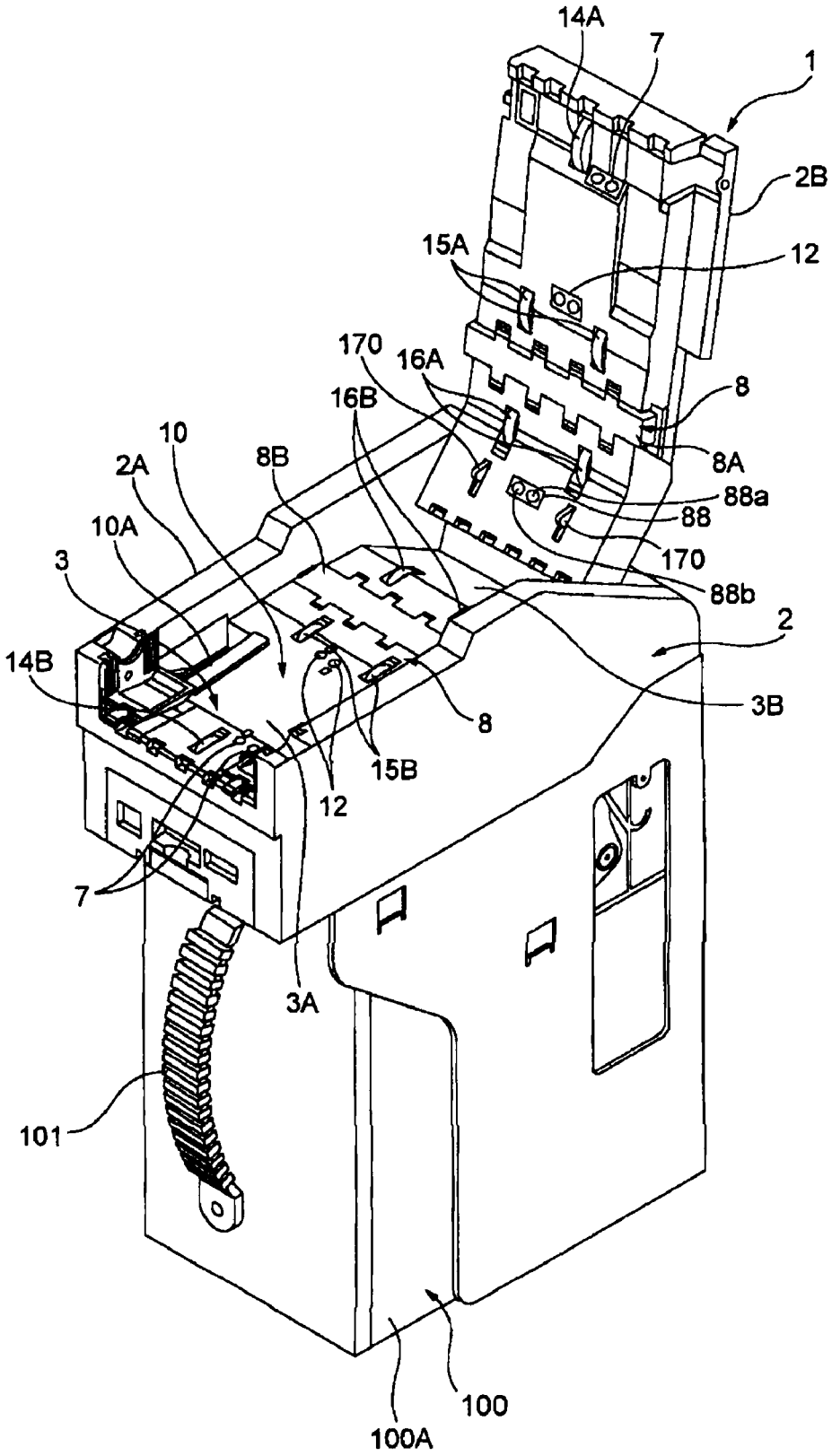
FIG. 2 is a perspective view showing the bill processing apparatus in a state that an open/close member is opened for a main body frame of an apparatus main body.
Figure 3:
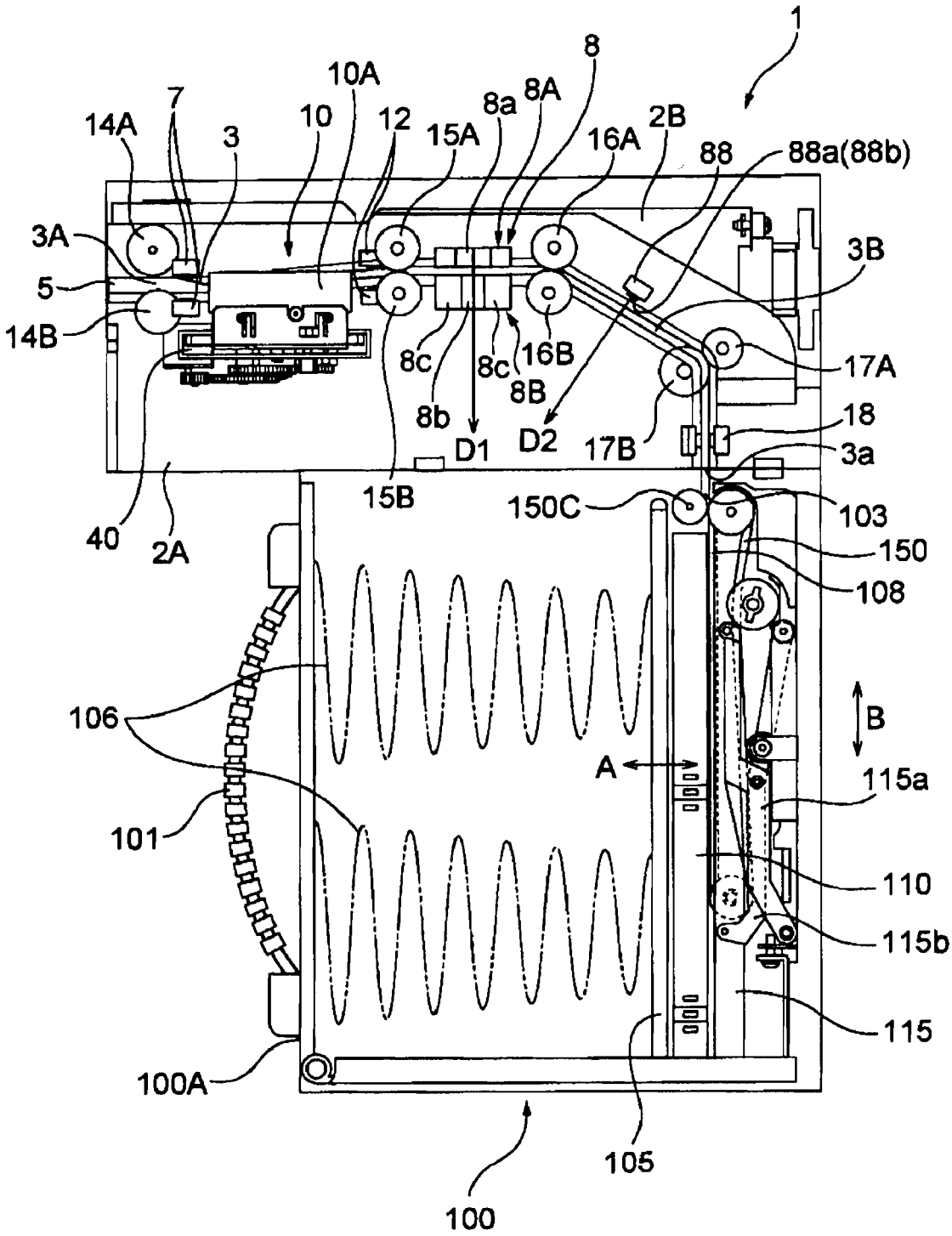
FIG. 3 is a right side view schematically showing a traveling route of a bill to be inserted from an insertion slot.
Figure 4:
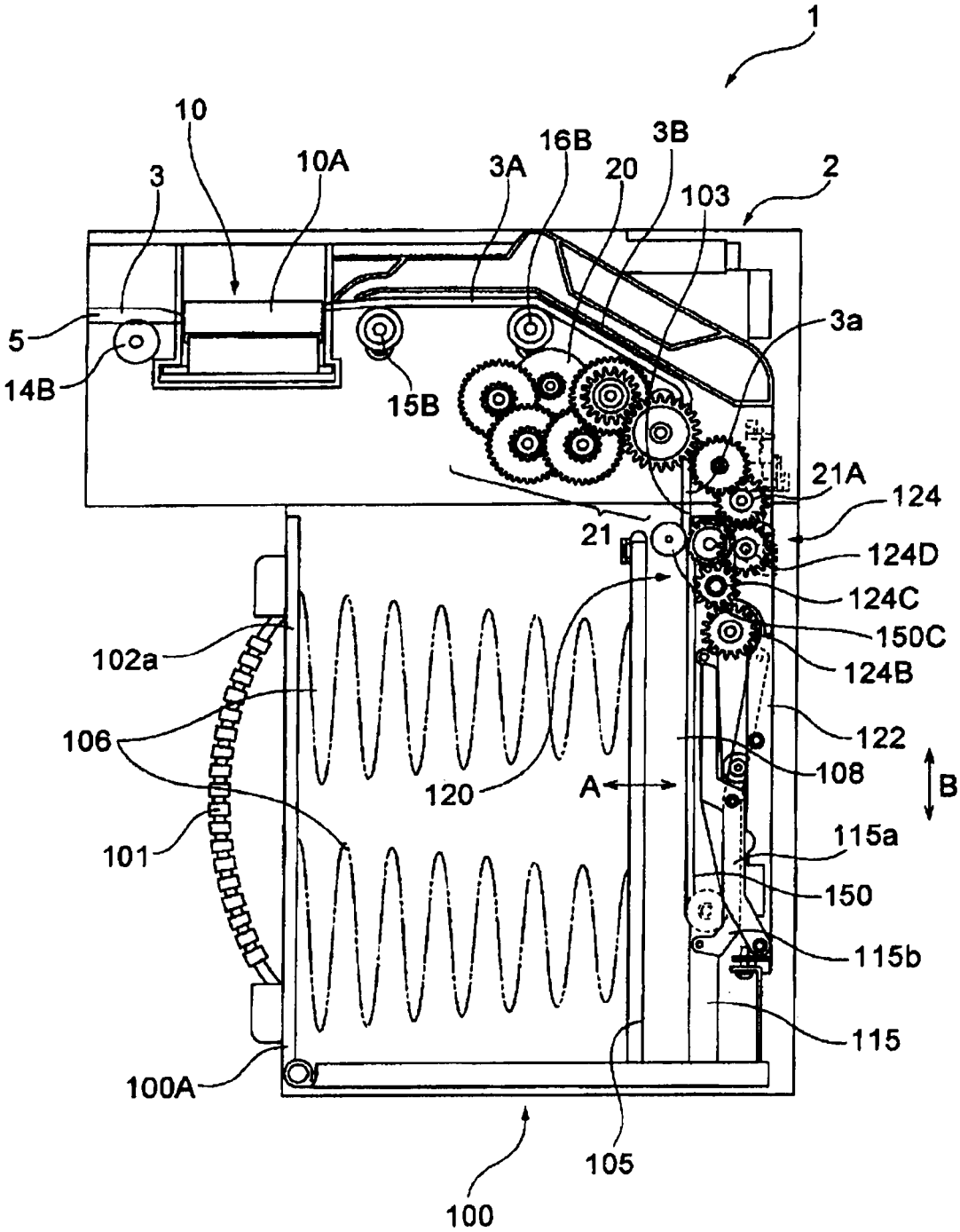
FIG. 4 is a right side view showing a schematic configuration of a power transmission mechanism for driving the presser plate arranged in a bill housing part.
Figure 5:
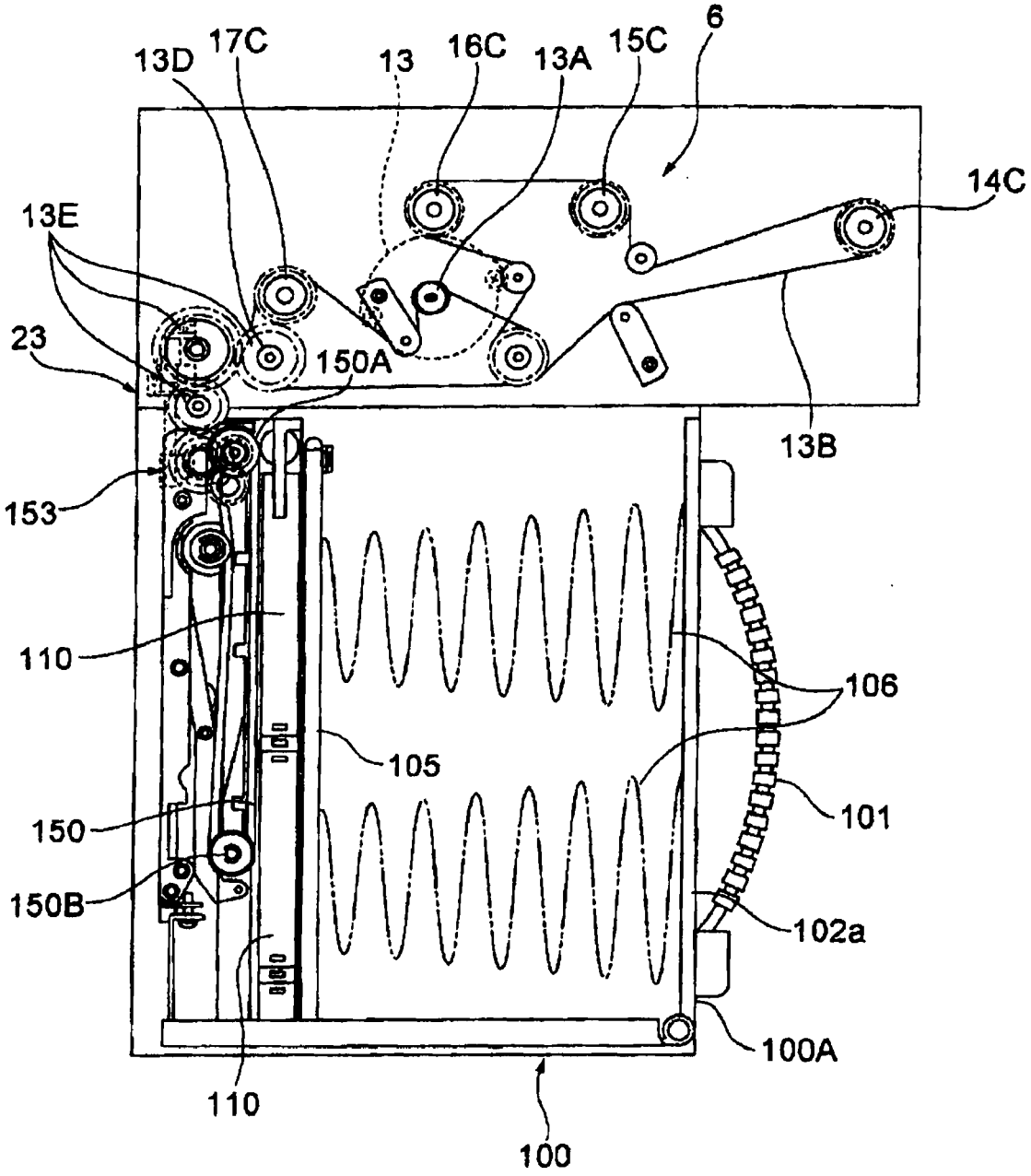
FIG. 5 is a left side view showing a schematic configuration of a driving source and a driving force transmission mechanism to drive a bill conveyance mechanism.

FIGS. 1 to 5 are diagrams showing a configuration of a bill processing apparatus to which a paper sheet processing apparatus is applied according to the present invention. FIG. 1 is a perspective view showing the entire structure; FIG. 2 is a perspective view showing a state that an open/close member is opened for a main body frame of an apparatus main body; FIG. 3 is a right side view showing schematically showing a traveling route for a bill inserted from an insertion slot; FIG. 4 is a right side view showing a schematic structure of a power transmission mechanism to drive a presser plate installed in a bill housing part; and FIG. 5 is a diagram showing a schematic structure of a driving source and a driving force transmission mechanism to drive a bill conveyance mechanism.

A bill processing apparatus 1 of this embodiment is so configured that it can be incorporated into, for example, various types of gaming machines such as a slot machine and the like, and the bill processing apparatus 1 includes an apparatus main body 2 and a housing part (e.g., stacker or cashbox) 100 which is provided to the apparatus main body 2 and is capable of stacking and housing a great number of bills. Here, the housing part 100 may be mountable to and demountable from the apparatus main body 2, and it is possible, for example, to remove from the apparatus main body 2 by pulling a handle 101 provided on the front face thereof in a state that a lock mechanism (not shown) is unlocked.

The above-mentioned bill processing apparatus 1 is configured to process, not only a bill, but also a paper sheet on which a bar code is printed so that the paper sheet may have an equivalent value to that of the bill. Such paper sheet on which the bar code is printed is made as a dedicated printer prints the bar code containing various types of information such as value information (information corresponding to the face value of the bill), issued date information, issued location information, and the like on a piece of paper formed in the same size as the bill, and the bill processing apparatus 1 is configured to judge the authenticity of the bill as well as the authenticity of such paper sheet on which the bar code is printed with bill reading means to be described later. That is, the bill processing apparatus 1 is configured to be capable of handling the paper sheet on which a dedicated bar code is printed as well the bill.

As shown in FIG. 2, the apparatus main body 2 has a main frame body 2A and an open/close member 2B being configured to be opened and closed for the main body frame 2A by rotating around an axis positioned at one end thereof as a rotating center. Then, as shown in FIG. 3, the frame 2A and the open/close member 2B are configured to form a space (bill traveling route 3) through which a bill is conveyed such that both face each other across the space when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means (first sensor) 8 that is installed on a downstream side of the insertion detecting sensor 7 and reads out information on the bill and the paper sheet on which the bar code is printed in a traveling sate; a skew correction mechanism 10 that accurately positions and conveys the bill with respect to the bill reading means 8; a movable piece passage detecting sensor 12 that detects that the bill passes through a pair of movable pieces constituting the skew correction mechanism; a bar code sensor (second sensor) 88 that is capable of reading out a bar code on the bill having been inserted as a printed face thereof is on a top face side when the bar code on the bill cannot be read out by the bill reading means 8; and a discharge detecting sensor 18 that detects that the bill is discharged into a bill housing part 100 are provided.

Hereafter, the respective components described above will be described in detail. The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 (refer to FIG. 5) serving as a driving source installed in the apparatus main body 2; and conveyor roller pairs (14A and 14B), (15A and 15B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

Thus, the upper conveyor roller 14A is controllably driven to be pressed against or spaced from the lower conveyor roller 14B by a motor 70 (refer to FIG. 6) for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

Further, the skew correction mechanism 10 comprises a pair of right and left movable pieces 10A (only one side is shown) such that the pair of right and left movable pieces 10A are moved to get closer with each other by driving a motor 40 for a skew driving mechanism, whereby the skew correction process is performed for the bill.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and when the detection signal is generated, the driving by the motor 13 is stopped such that the skew correction is made. The movable piece passage detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the second traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means (first sensor) 8 reads bill information (bar code information) on the bill (paper sheet on which a bar code is printed) conveyed in a state that the skew is eliminated by the skew correction mechanism 10, and determines the validity (authenticity). In this embodiment, the bill reading means 8, which is installed in the above-mentioned first traveling route 3A, comprises a line sensor which irradiates the bill (paper sheet on which a bar code is printed) being conveyed from top and bottom sides thereof with light such that transmitted light and reflected light thereof are detected by a light receiving element so as to perform reading.

The bill authenticity identification process according to this embodiment is performed by letting light emitting means irradiate light having a predetermined wavelength to a printed area on a surface of the bill being conveyed, acquiring transmitted-light data of the light transmitted through the bill and reflected-light data of the light reflected by the bill, and comparing such data with the reference data of the legitimate bill having stored in advance such that the identification accuracy may be improved.

Here, a concrete bill authenticity identification method will not be written in detail since it is possible to acquire various kinds of received-light data (transmitted-light data and reflected-light data) depending on the wavelengths of the irradiated lights to the bill and the irradiated areas of the bill. However, for example, in a watermarked area of the bill, if an image on the area is viewed with lights of different wavelengths, the image appears greatly different depending on the lights. Therefore, it can be considered that the bill to become an identification object is identified as the legitimate bill or the counterfeit bill by setting this portion as the specified area, acquiring transmitted-light data and reflected-light data from the specified area, and comparing such data with legitimate data from the same specified area of the legitimate bill having been stored in advance in storage means (ROM). At this time, provided that specified areas are predetermined according to the kind of the bill, predetermined weighting may be applied to the transmitted-light data and the reflected-light data from this specified area, thereby enabling improvement of the authenticity identification accuracy.

Concretely, the bill reading means 8 has a light emitting unit 8A which is installed on the side of the open/close member 2B and provided with a transmission light emitting part (first light emitting part) 8*a* capable of irradiating the upper side of the bill to be conveyed with the light, and a light receiving/emitting unit 8B which is installed on the side of the main body frame 2A.

The light receiving/emitting unit 8B has a light receiving part (first light receiving part) 8*b* which is provided with a light receiving sensor (to be configured as a line sensor in this embodiment) facing the first light emitting part 8*a* across the bill, and reflection light emitting parts 8*c* which are installed adjacently on the both sides of the light receiving part 8*b* along the bill traveling direction.

The transmission light emitting part (first light emitting part) 8*a* so arranged as to face the light receiving part 8*b* works as a light source for transmission for a bill to be conveyed. As shown in FIG. 3, the transmission light emitting part 8*a* irradiates the bill to be carried with light in a direction D1 of irradiation substantially perpendicular to the bill to be conveyed (the direction D1 of irradiation). This transmission light emitting part 8*a* may be constituted of a rectangular bar-like body made of synthetic resin that emits light through, for example, an LED element attached to its one end via a light guiding body. The transmission light emitting part 8*a* having such a configuration is linearly installed in parallel with the light receiving part 8*b* (first light receiving part; line sensor) so as to be capable of entirely and equally irradiating the entire range in the width direction of the traveling route of the bill to be conveyed although the configuration is simple.

The light receiving part 8*b* of the light receiving/emitting unit 8B is formed in a thin-walled plate shape having a band shape extending in a lateral direction of the bill traveling route 3 and having a width to an extent that the sensitivity of the light receiving sensor (not shown) provided in the light receiving part 8*a* is not affected. In addition, the light receiving sensor is configured as a so-called line sensor in which a plurality of CCDs (Charge Coupled Devices) are provided linearly in the center in the thickness direction of the light receiving part 8*b*, and a GRIN lens array is disposed linearly above these CCDs so as to collect the transmitted light and the reflected light. Therefore, it is possible to receive the transmitted light or the reflected light emitted from the transmission light emitting part 8*a* or the reflection light emitting parts 8*c* such that the bill serving as the object for the authenticity judgment is irradiated, and generate contrasting density data according to its luminance (pixel data containing information of brightness) as the received-light data and a two-dimensional image on the basis of the contrasting density data.

Also, the reflection light emitting part 8*c* of the light receiving/emitting unit 8B may, in a similar manner as with the transmission light emitting part 8*a*, be constituted of a rectangular bar-like body made of synthetic resin that can irradiate light entirely and equally from an LED element attached to its one end via a light guiding body. The reflection light emitting parts 8*c* are also configured to be linearly installed in parallel with the light receiving part 8*b* (line sensor).

The reflection light emitting parts 8*c* are capable of irradiating a bill with light at a predetermined angle of elevation, and are installed to eventually receive a reflected light from the bill in the direction D1 in FIG. 3 (the same direction as the direction D1 of irradiation of the first light emitting part 8*a*) by the light receiving part 8*b*. In this case, the direction of irradiation from the reflection light emitting parts 8*c* may be variously modified as far as the surface of the bill is irradiated equally without causing contrasting of the irradiation, and the arrangement of the reflection light emitting parts 8*c* and the light receiving part 8*b* may be appropriately redesigned in accordance with a structure of the bill processing apparatus. Further, the reflection light emitting parts 8*c* may be arranged on both sides of the light receiving part 8*b* so as to place it therebetween, and the reflection light emitting parts 8*c* disposed on the both sides may respectively irradiate the light to the bill by the same angle of incidence from their own places. This is because, in the case where the surface of the bill has scratches or folded wrinkles, and in the case where the light is irradiated only from one side to an uneven surface generated by these scratches or folded wrinkles, it is unavoidable to make some portions shaded to cause shadow in the uneven surface. Therefore, it is prevented that the shadow is made in the portion of the uneven surface by irradiating the bill with the lights from the both sides, whereby the image data to be acquired can have a higher degree of accuracy than that of the single side irradiation.

In addition, the configuration, the arrangement, and the like of the light emitting unit 8A and the light receiving/emitting unit 8B as described above are not limited to those described in this embodiment, and may be modified as appropriate.

Further, the bar code sensor (second sensor) 88 is installed in the second traveling route 3B formed to be bent to the first traveling route 3A, and more specifically is disposed between the conveyor roller pair (16A and 16B) and the conveyor roller pair (17A and 17B), and is constituted of an optical type of reflective photo sensor. This bar code sensor 88 is, as shown in FIGS. 2 and 3, installed on the upper side in the second traveling route 3B, and the light emitting part (second light emitting part) 88*a* is configured to emits the light in a direction D2 which is different from the direction D1 of irradiation of the first light emitting part 8*a*. Then, the light emitted by the second light emitting part 88*a* is reflected on the surface of the paper sheet and received by the light receiving part (second light receiving part) 88*b* installed adjacently to the light emitting part. In this case, as long as the light emitting part (second light emitting part) 88*a* is in such a positional arrangement that the direction D2 of irradiation of the light is different from the direction D1 of irradiation of the first light emitting part 8*a* of the first sensor 8, and the positional arrangement may be appropriately re-designed in accordance with a structure of the bill processing apparatus. Meanwhile, in the case of this embodiment, an angle formed by the irradiation directions D1 and D2 of the lights corresponds to a predetermined angle at which the second traveling route 3B is inclined to the first traveling route 3A. Further, since the light from the second light emitting part 88*a* is reflected on the surface of the paper sheet and then received by the second light receiving part 88*b* installed adjacently to the light emitting part in the width direction, the direction of its light path is different by approximately 90 degrees from that in the case where the light from the reflection light emitting parts 8*c* is reflected on the rear surface of the paper sheet and then received by the light receiving part 8*b*. Therefore, it is possible to read a factor to specify a paper sheet with a different characteristic.

Further, the bar code sensor (second sensor) 88 has, as described above, a function of reading the bar code when the bar code on the paper sheet to be conveyed cannot be read out by the bill reading means (first sensor) 8 (for the bar code of the paper sheet inserted as a printed surface thereof is set on the upper side). Further, the bar code sensor 88 may also have other functions than that of reading the bar code. For example, as will be described later, a function of monitoring a movement of the bill waiting in an escrow position or the paper sheet on which the bar code is printed may be provided thereto in addition to the above function.

The bill housing part 100 which houses the above-described bill and the like is so configured as to stack and house sequentially bills (including paper sheets on which bar codes are printed) identified as being genuine by the bill reading means 8.

As shown in FIGS. 3 to 5, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill M1 of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 3 and 4, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 4, a housing part side gear train 124 constituting the presser plate driving mechanism 120 is connected to the pinion. For this case, as shown in FIG. 4, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 by the bill conveyance mechanism 6. As shown in FIG. 3, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 170 that prevents the bill from being conveyed toward the bill insertion slot 5 by a fraudulent activity is installed in the second traveling route 3B.

Next, control means 200 that controls the driving of the bill conveyance mechanism 6, the bill reading means (first sensor) 8, a bar code sensor (second sensor) 88, and the like as mentioned above will be described with reference to a block diagram of FIG. 6.

Figure 6:
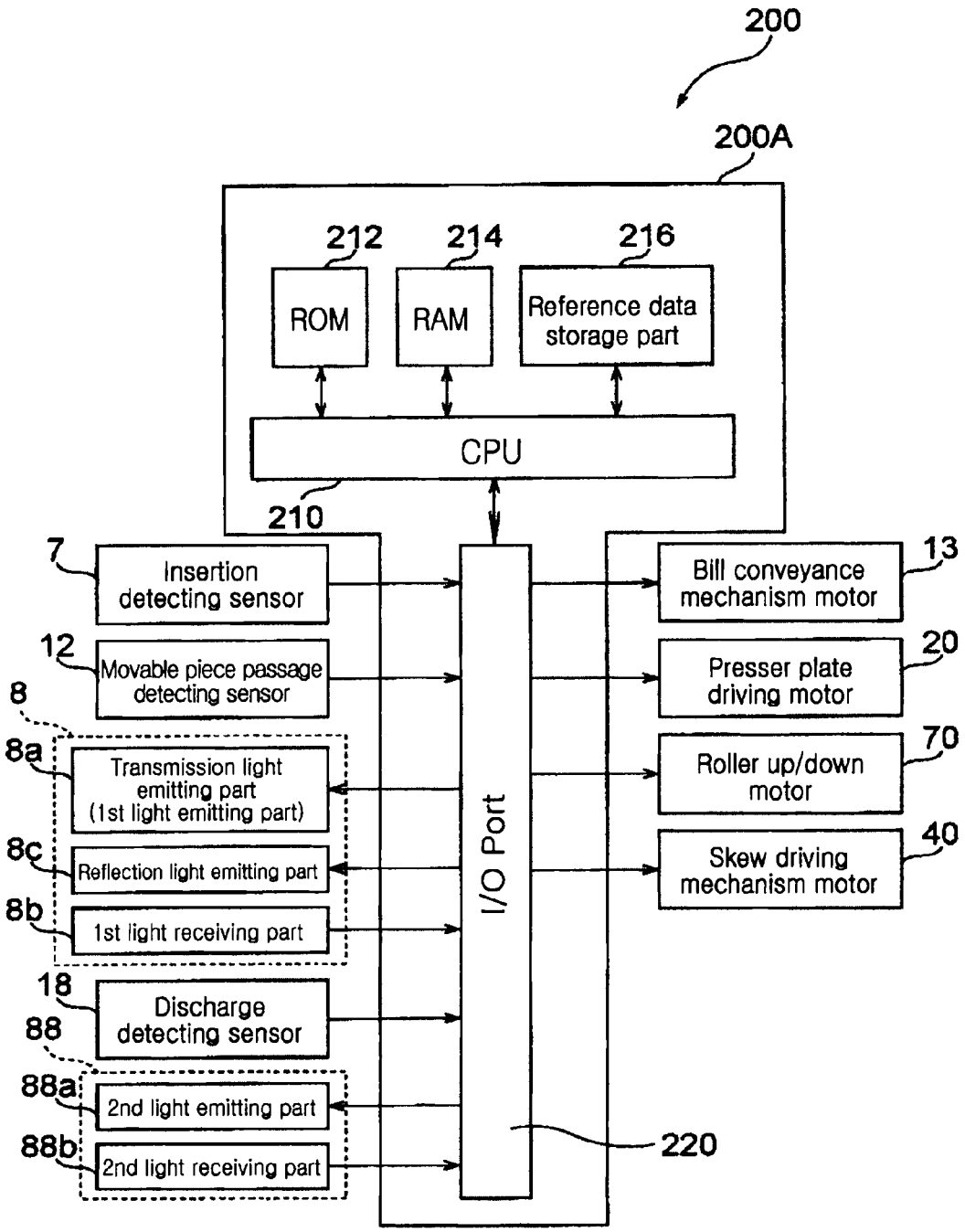
Figure 7:
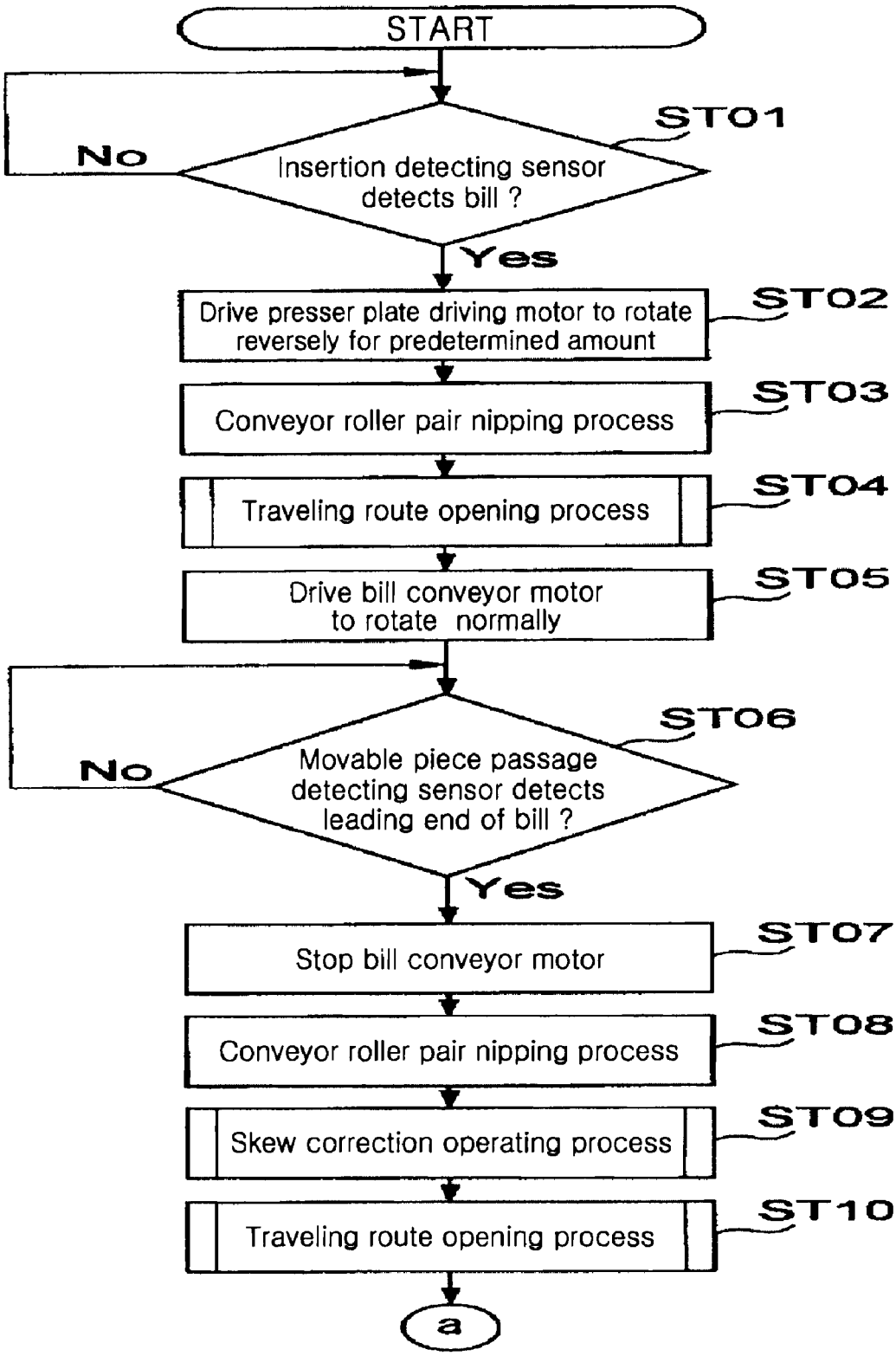
FIG. 7 shows a flowchart (part one) illustrating processing operations for processing a bill in a bill processing apparatus of this embodiment.
Figure 8:
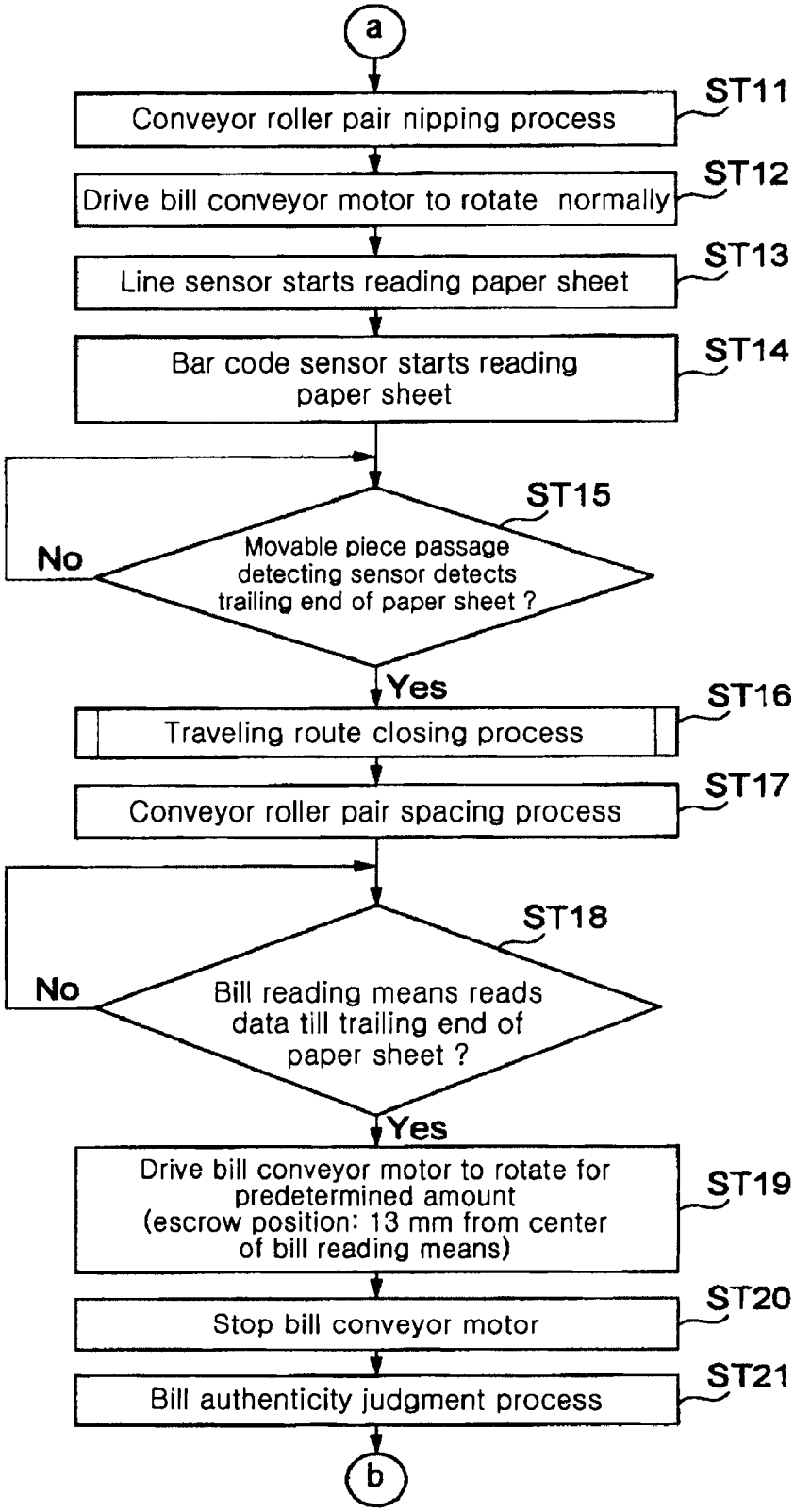
FIG. 8 shows a flowchart (part two) illustrating processing operations for processing the bill in the bill processing apparatus of this embodiment.
Figure 9:
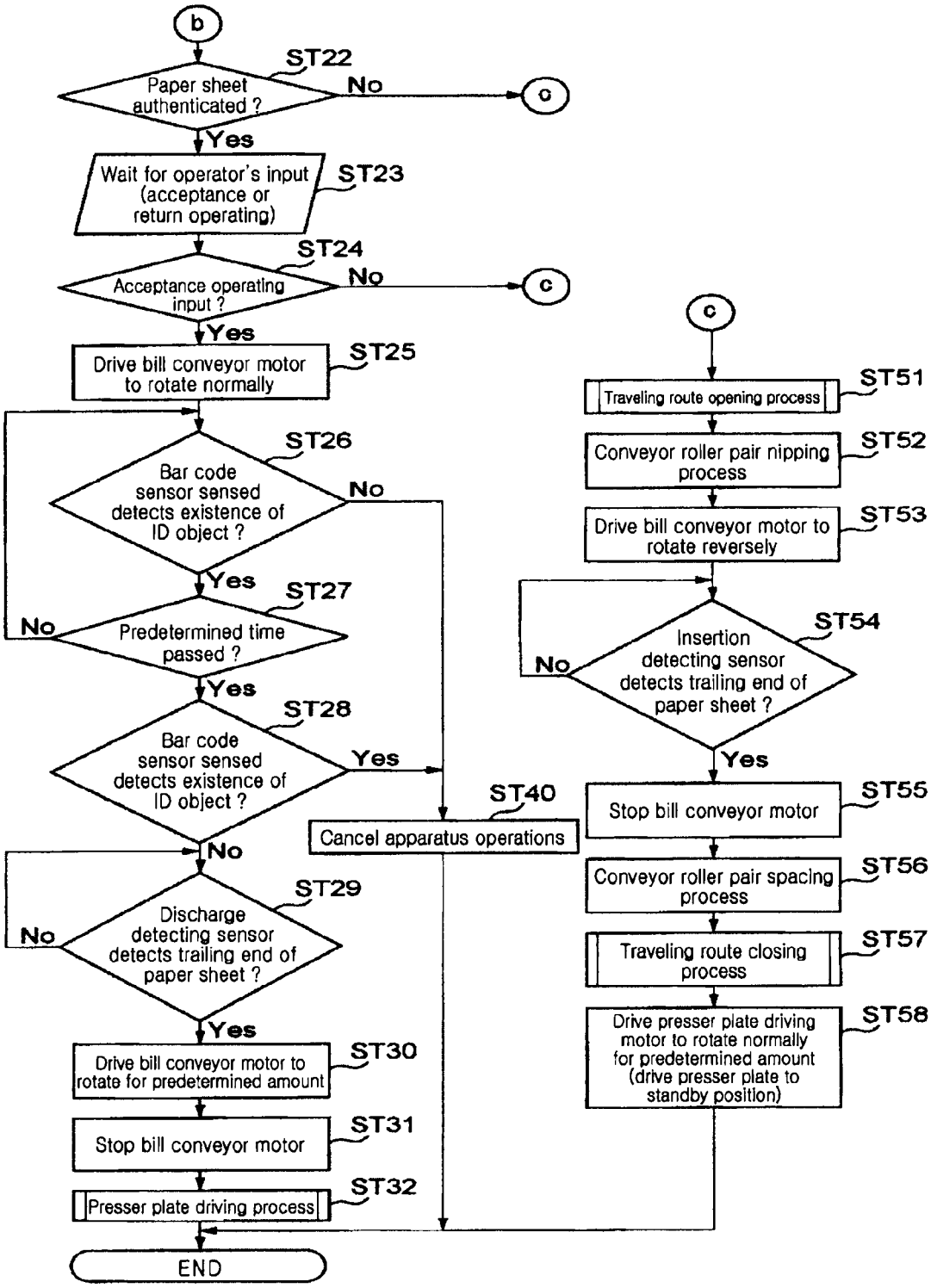
FIG. 9 shows a flowchart (part three) illustrating processing operations for processing the bill in the bill processing apparatus of this embodiment.
Figure 10:
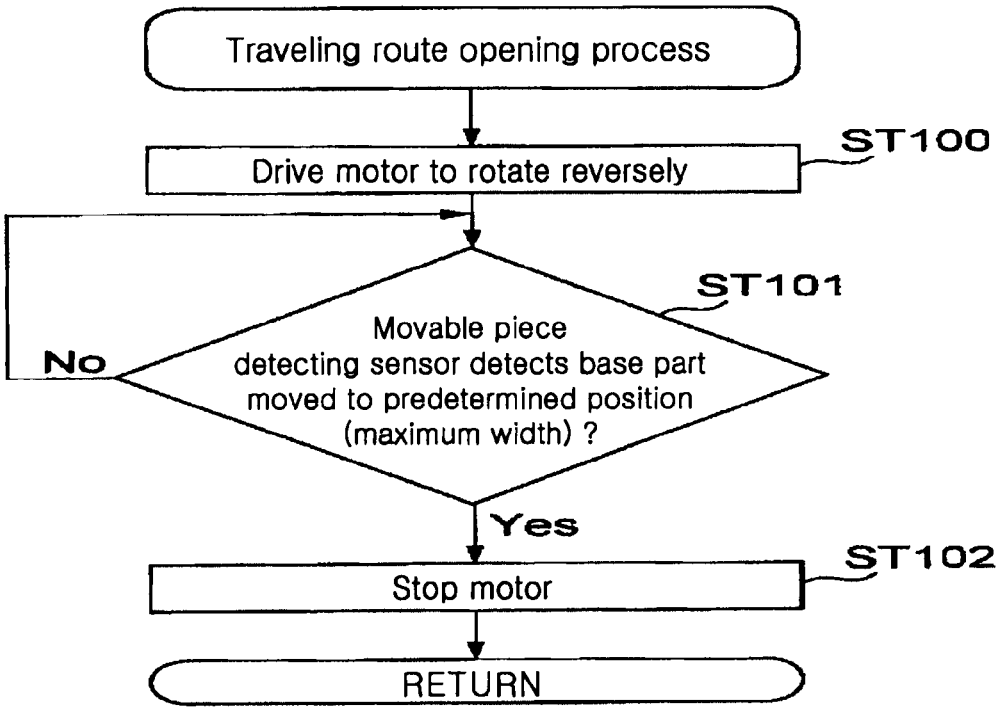
FIG. 10 shows a flowchart illustrating processing operations of a traveling route opening process.

The control means 200 as shown in a block diagram of FIG. 6 comprises a control board 200A which controls the operations of the above-described respective drive units, and a CPU (Central Processing Unit) 210 controlling driving of each drive unit and constituting the bill identification means, a ROM (Read Only Memory) 212, a RAM (Random Access Memory) 214, and an reference data storage part 216 are implemented on the control board 200A.

In the ROM 212, permanent data such as various types of programs such as an authenticity judgment program in the authenticity judging part, operation programs for the respective drive units such as the motor 13 for the bill conveyance mechanism, the motor 20 for the presser plate, the motor 40 for the skew correction mechanism, and the roller up-and-down motor 70 for lifting up and down rollers, and the like are stored.

The CPU 210 operates according to the programs stored in the ROM 212, and carries out input and output of the signals with respect to the respective drive units described above via an I/O port 220, so as to perform the entire operational control of the bill processing apparatus. That is, the motor 13 for the bill conveyance mechanism, the motor 20 for the presser plate, the motor 40 for the skew correction mechanism, the roller up-and-down motor 70, and the transmission light emitting part 8*a* and the reflection light emitting part 8*c* of the above-mentioned bill reading means 8 are connected to the CPU 210 via the I/O port 220. The operations of these drive units are controlled by control signals transmitted from the CPU 210 in accordance with the operation programs stored in the ROM 212.

Further, the CPU 210 is so configured that detection signals from the insertion detecting sensor 7, the movable piece passage detecting sensor 12, the discharge detecting sensor 18, and the bar code sensor (second sensor) 88 are input into the CPU 210 via the I/O port 220, and the driving of the respective drive units is controlled based on these detection signals.

Moreover, a detection signal based on a transmitted light or a reflected light of the light which is irradiated to the bill or the bill on which the bar-code is printed (identification object), is input to the CPU 210 via the I/O port 220 from the first light receiving part 8*b* in the above-mentioned bill reading means (first sensor) 8, and the detection signal is compared with the reference data stored in the reference data storage part 216 to execute the authenticity judgment process for the bill or the paper sheet on which the bar-code is printed. Further, a detection signal about the bar code of the paper sheet to be conveyed with the bar code on the top surface is also input to the CPU 210 via the I/O port 220 from the second light receiving part 88*b* of the bar code sensor (second sensor), and the detection signal is compared with the reference data stored in the reference data storage part 216 to execute the authenticity judgment process for the paper sheet on which the bar-code is printed.

The RAM 214 stores data and programs used for the CPU 210 to operate, and the reference data storage part 216 stores reference data used for executing the authenticity judgment process for the bill or the paper sheet on which the bar-code is printed. Here, the reference data is stored in the dedicated reference data storage part 216. However, the data may be stored in the ROM 212.

Next, the bill processing operation in the bill processing apparatus 1 executed by the control means 200 will be described according to the flowcharts of FIGS. 7 to 13.

When an operator inserts a bill or a paper sheet on which a bar code is printed (hereinafter, these are referred to as "paper sheet") into the bill insertion slot 5, the conveyor roller pair (14A and 14B) installed in the vicinity of the bill insertion slot is in a state that the rollers are spaced from each other in an initial stage (refer to ST17 and ST56 to be described later). Further, with respect to the presser plate 115, the pair of link members 115*a*, 115*b* driving the presser plate 115 are positioned in the press standby part 108, and the pair of link members 115*a*, 115*b* prevent the paper sheet from being conveyed into the press standby part 108 from the receiving port 103. That is, in this state, the presser plate 115 is brought into the opening formed between the pair of regulatory members 110 such that the condition is so made as to prevent the paper sheets stored in the bill housing part from being drawn out through the opening.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST16 and ST57 to be described later) so as to prevent the paper sheet from being drawn out in the initial stage.

In the initial state of the above-described pair of conveyor rollers (14A and 14B), it is possible for the operator to easily insert even a paper sheet having wrinkles into the paper sheet insertion slot 5. Then, when insertion of the paper sheet is detected by the insertion detecting sensor 7 (ST01), the driving motor 20 of the above-described presser plate 115 is driven to rotate reversely for a predetermined amount (ST02) to move the presser plate 115 to the initial position. That is, the presser plate 115 is in a state that the presser plate 115 is moved and remains in the opening formed between the pair of regulatory members 110 such that it is so arranged that the paper sheet cannot pass through the opening until the insertion of a paper sheet is detected by the insertion detecting sensor 7.

When the presser plate 115 is moved from the standby position to the initial position, the press waiting part 108 becomes in an open state (refer to FIG. 4) such that the apparatus is in a state that the paper sheet can be conveyed into the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack formed on the movable member 122, and the link members 115*a*, 115*b*).

Further, the above-described roller up-and-down motor 70 is driven to move the upper conveyor roller 14A so as to make a contact with the lower conveyor roller 14B. In accordance therewith, the inserted paper sheet is nipped and held therebetween by the pair of conveyor rollers (14A and 14B) (ST03).

Next, a traveling route opening process is conducted (ST04). The opening process is conducted by driving the pair of movable pieces 30A, 30B to move in separating directions so as to become apart with each other as the motor 40 for the skew correction mechanism is driven to rotate reversely as shown in the flow chart of FIG. 10 (ST100). At this time, when it is detected that the pair of movable pieces 10A have moved to the predetermined positions (the maximum open width positions) by the base part detecting sensor that detects positions of the pair of movable pieces 10A (ST101), the driving operation to rotate the motor 40 reversely is stopped (ST102). This traveling route opening process allows the paper sheet to enter between the pair of movable pieces 10A. In addition, in the previous step of ST04, the bill traveling route 3 is in a closed state by a traveling route closing process (ST16, ST57) to be described later. Thus, the bill traveling route 3 is closed in this way before an insertion of the paper sheet so as to prevent an element such as a line sensor from being broken by, for example, inserting a plate-like member from the bill insertion slot for illicit purposes or the like.

Next, the bill conveyor motor 13 is driven to rotate normally (ST05). The paper sheet is conveyed into the inside of the apparatus by the conveyor roller pair (14A and 14B), and when the movable piece passage detecting sensor 12 installed on the downstream side from the skew correction mechanism 10 detects the leading end of the paper sheet, the bill conveyor motor 13 is stopped (STO6 and ST07). At this time, the paper sheet is located between the pair of movable pieces 10A constituting the skew correction mechanism 10.

Next, the above-described roller un-and-down motor 70 is driven to allow the conveyor roller pair (14A and 14B) holding the paper sheet therebetween to become apart from each other (ST08). At this time, the paper sheet is in a state that no load is applied.

Figure 11:
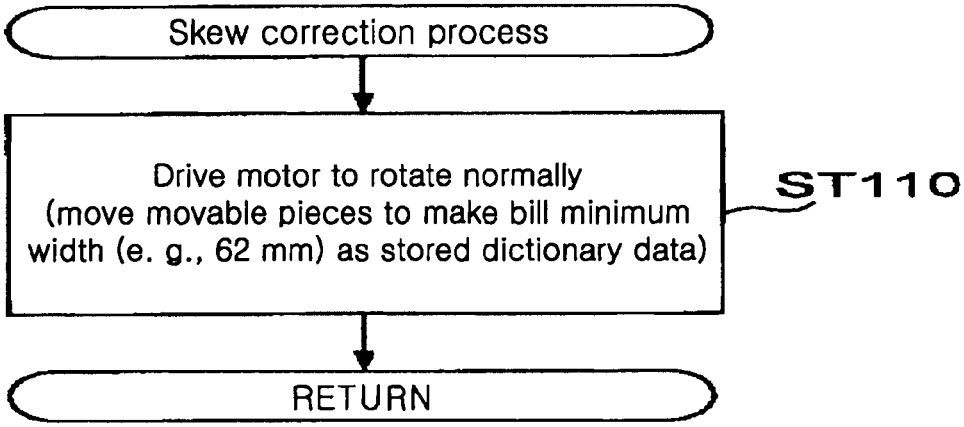
FIG. 11 shows a flowchart illustrating processing operations of a skew correction operating process.

Then, a skew correction operating process is executed as the paper sheet remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 11, the motor 40 described above is driven to rotate normally to move the pair of movable pieces 10A in respective directions such that the pair of movable pieces 10A get closer with each other (ST110). The movement of the movable pieces is continued until the distance therebetween becomes the minimum width (for example; width of 62 mm) of the bill registered in the reference data storage part in the control means. And the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 10).

Next, the above-described roller up-and-down motor 70 is driven to move the upper conveyor roller 14A to contact the lower conveyor roller 14B, and the paper sheet is nipped and held between the pair of conveyor rollers (14A and 14B) (ST11). Thereafter, the bill conveyor motor 13 is driven to rotate normally to convey the paper sheet into the inside of the apparatus, and when the paper sheet passes through the bill reading means 8, a reading process of the paper sheet is executed (ST12 and ST13). Further, in accordance therewith, the bar code sensor 88 starts reading the paper sheet (ST14).

Figure 12:
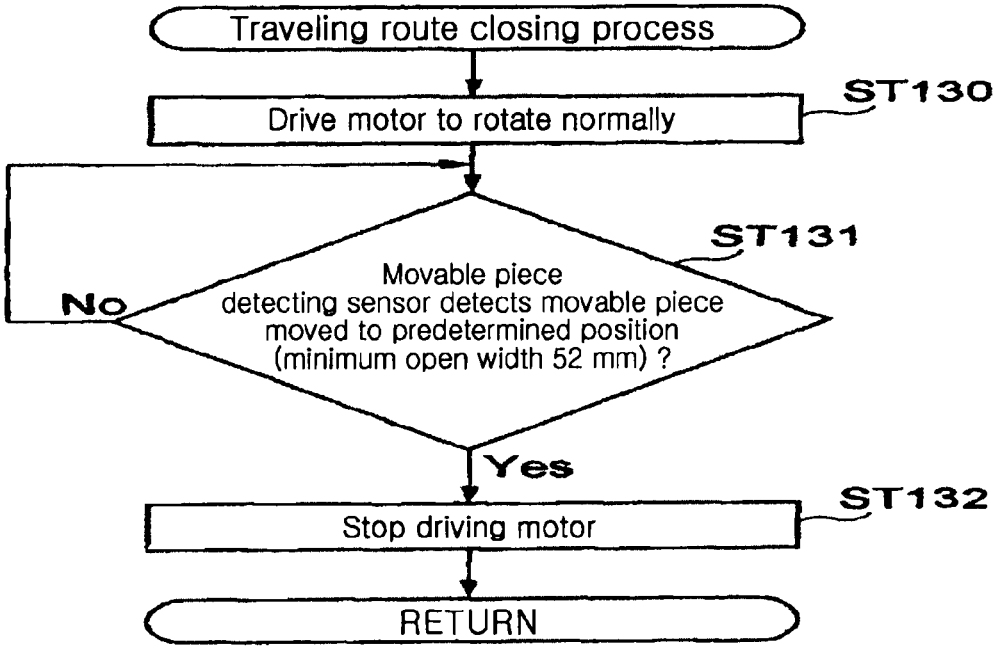
FIG. 12 shows a flowchart illustrating processing operations of a traveling route closing process.

Then, when the paper sheet to be conveyed passes through the paper sheet reading means 8, and the trailing end of the paper sheet is detected by the movable piece detecting sensor 12 (ST15), a process for closing the bill traveling route 3 is executed (ST17). In this process, first, as shown in the flowchart of FIG. 12, after the trailing end of the paper sheet is detected by the movable piece detecting sensor 12, the above-described motor 40 is driven to normally rotate to move the pair of movable pieces 10A in the directions that they get closer to each other (ST130). Next, when it is detected by the movable piece detecting sensor that the movable pieces 10A move to the predetermined positions (minimum open width positions: for example, width of 52 mm) (ST131), the driving operation of the normal rotation of the motor 40 is stopped (ST132).

With this traveling route closing process, the pair of movable pieces 10A are moved to the positions of the minimum open width (width of 52 mm) narrower than the width of any paper sheet allowed to be inserted, thereby effectively preventing the paper sheet from being drawn out. That is, by executing such a bill traveling route closing process, an opening distance between the movable pieces 10A is made shorter than the width of the inserted paper sheet, thereby enabling the effective prevention of an action of drawing-out the paper sheet in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may blink, or without activating a process for input acceptance (ST23) input by another operator thereafter, a process in which a discharge operation or the like is forcibly conveyed out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST16), a conveyor roller pair spacing process is executed such that the above-mentioned roller up-and-down motor 70 is driven to make the conveyor roller pair (14A, 14B) having been in a state capable of nipping and holding the paper sheet therebetween separate from each other (ST17). By executing the conveyor roller pair spacing process, even if the operator additionally inserts (double insertion) another paper sheet by mistake, the paper sheet is not subject to a feeding operation by the conveyor roller pair (14A, 14B) and hits front ends of the pair of movable pieces 10A in a closed state according to ST16 such that it is possible to reliably prevent the operation of paper sheet double-insertion.

Along with the bill traveling route closing process, when the bill reading means 8 reads the data up to the trailing end of the paper sheet, the bill conveyor motor 13 is driven for a predetermined amount and stops the paper sheet in a predetermined position (an escrow position; a position where the paper sheet is conveyed toward the downstream by 13 mm from the center position of the bill reading means 8), and at this time, an authenticity judgment process of the paper sheet is executed by referring to the legitimate data stored in the reference data storage part 216 of the aforementioned control means 200 (ST18 to ST21).

In addition, this escrow position is defined as a position where the bar code sensor 88 can complete reading of the bar code of the paper sheet inserted as the printed bar code is on the upper face, and detect the paper sheet.

Then, in the authenticity judgment process in ST21 described above, when the paper sheet is judged as the legitimate one (ST22; Yes), an input from the operator is received (ST23). This input corresponds to an acceptance operation in which the operator presses an acceptance button in order to accept provision of services (for example, an acceptance process according to the start of a game in the case of a gaming unit), and a process in which the operator presses a return button in order to execute a process for returning the inserted paper sheet.

Figure 13:
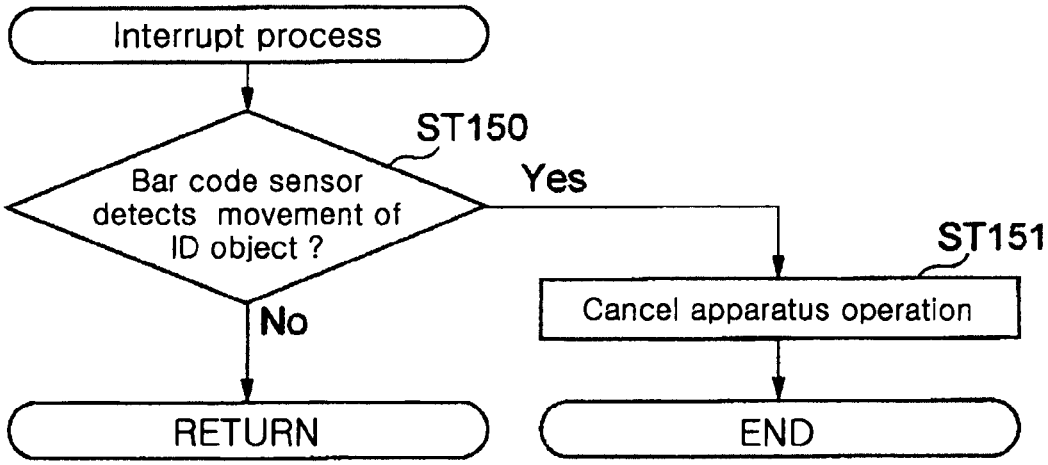
FIG. 13 shows a flowchart illustrating interrupt processing based on a detection signal of a bar code sensor.

Further, during execution of the processes in ST22 and ST23, an interrupt process as shown in FIG. 13 is executed. With respect to this interrupt process, when the bar code sensor 88 detects a movement of the identification object (ST150; Yes), which means that the paper sheet supposedly staying in the escrow position is moved, and it is regarded as some kind of fraudulent activity such as drawing out activities being committed, a process of cancelling the operation of the apparatus (for example, stopping of the conveyance mechanism, discharging of a paper sheet, stopping of a transaction process with higher-level apparatuses, and the like) is executed (ST151).

As described above, in a state that the paper sheet is stopped and staying at the escrow position, it is likely that a fraudulent activity may be committed. However, when a movement of the paper sheet is detected at the escrow position by the bar code sensor 88, the operation of the conveyance mechanism 6 may be cancelled or disabled such that it can be reliably prevent such a fraudulent activity.

Then, when an operation to accept the provision of various types of services is input (ST24; Yes), the bill conveyor motor 13 is consecutively driven to rotate normally to convey the paper sheet in this state toward the bill housing part 100 (ST25).

In the process of ST25, the bar code sensor 88 has detected an existence of the identification object (ST26), and when the existence of the paper sheet is not recognized at the stage of a conveying process for the paper sheet (within a period of time of a movement of the paper sheet), it is judged that the paper sheet has been drawn out or the like, and a process of cancelling and disabling the operation of the apparatus (ST26; No., ST40) is executed. This process of cancelling and disabling corresponds to a process of stopping the operation of the conveyance mechanism 6 so as to be incapable of conveying a paper sheet, a discharge operation for the paper sheet, stopping of a transaction process with higher-level apparatuses, and the like. Further, in the process of ST25, since the period of time of the movement of the paper sheet from the bar code sensor 88 is specified, the period has been detected (ST27), and when the bar code sensor 88 detects the presence of the identification object after the time passes (ST27; Yes), it is judged that the paper sheet is jammed, a process of cancelling and disabling the operation of the apparatus as described above is executed (ST28; No, ST40).

In this way, in this embodiment, the bar code sensor 88 has a function to detect the existence of a paper sheet, and the operation of the conveyance mechanism 6 is cancelled and disabled on the basis of a detection result from the bar code sensor 88 and the time in which a paper sheet is moved by the conveyance mechanism 6 to pass through the bar code sensor 88, by the above-described control means 200.

That is, in considering that a period of time for the paper sheet to pass can be specified by the bar code sensor 88 when the paper sheet is moved, the operation of the conveyance mechanism 6 is cancelled and disabled if the bar code sensor 88 detects the existence of the paper sheet even after the specified period of time or if the paper sheet cannot be detected within the passing period of time. Accordingly, it is possible to detect jamming of the paper sheet, or effectively prevent a fraudulent activity such as an activity of drawing out the paper sheet.

Then, when the paper sheet is conveyed in the above-mentioned process of ST25, the bill conveyor motor 13 is driven to rotate normally until the trailing end of the paper sheet is detected by the discharge detecting sensor 18 (ST29), and after the trailing end of the paper sheet is detected by the discharge detecting sensor 18, the bill conveyor motor 13 is driven to rotate normally for the predetermined amount (ST30 and ST31).

The process for driving the bill conveyor motor 13 to rotate normally in ST30 and ST31 corresponds to a driving amount for which the paper sheet is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide it stably to the press standby part 108. That is, by further driving the bill conveyor motor 13 to rotate normally for a predetermined amount after the trailing end of the paper sheet is detected by the discharge detecting sensor 18, the pair of belts 150 contact the paper sheet conveyed-in and are driven in the feeding direction so as to guide the paper sheet in a stable state to the press standby part 108.

Then, after the above-described bill conveyor motor 13 is stopped, the process for driving the presser plate 115 is executed (ST32) such that the paper sheet is placed on the placing plate 105. And, after the pressing process is completed, the presser plate 115 is again moved to the standby position and stopped to the position.

Further, in the above-mentioned process of ST22, when the paper sheet is judged as a non-legitimate one (ST22; No) or the operator presses the return button (ST24; No), a traveling route opening process is executed (ST51, refer to ST100 to ST102 of FIG. 10). After that, the bill conveyor motor 13 is driven to rotate reversely and the conveyor roller pair (14A, 14B) are brought into contact with each other such that the paper sheet waiting at the escrow position is conveyed toward the bill insertion slot 5 (ST52 and ST53). Then, when the insertion detecting sensor 7 detects the trailing end of the paper sheet to be returned toward the bill insertion slot 5, the driving to reversely rotate the bill conveyor motor 13 is stopped, and above-described roller up-and-down motor 70 is driven to make the conveyor roller pair (14A and 14B) in a state of nipping and holding the paper sheet therebetween separate from each other (ST54 to ST56). After that, the traveling route closing process is executed (refer to ST57, and ST130 to ST132 in FIG. 12) and the driving motor 20 for the presser plate 115 is driven to rotate normally (ST58) such that the presser plate 115 positioned at the initial position is driven to move to the standby position, and then a series of processes are completed.

According to the above-mentioned configuration of the bill processing apparatus 1, it is possible to judge the authenticity of the identification object to be conveyed in the traveling route based on the detection results by the first sensor 8 and the second sensor 88. In this case, since the light emitting part (first light emitting part 8*a*) of the first sensor 8 and the light emitting part (second light emitting part 88*a*) of the second sensor 88 have different irradiation directions as shown by the arrows D1 and D2 in FIG. 3, when the light receiving parts 8*b* and 88*b* in the respective sensors 8 and 88 receive lights, the light interference is mutually suppressed whereby the identification object can be read accurately.

In particular, in this embodiment, since the first sensor 8 is installed in the first traveling route 3A, and the second sensor 88 is installed in the second traveling route 3B which is inclined at a predetermined angle to the first traveling route 3A, it is possible to easily change the irradiation directions of the first light emitting part 8*a* of the first sensor and the second light emitting part 88*a* of the second sensor 88. Further, since it is difficult for the light from the light emitting part of one of the sensors to reach the light receiving part of the other sensor due to its bent portion, it is possible to more effectively suppress the interference of light whereby the identification object can be read accurately.

As mentioned above, the embodiment of the present invention is described. However, the present invention is not limited to the above-described embodiment, and various modifications of the present invention can be implemented. In the present invention, it suffices that the irradiation direction D1 of the light emitting part of the first sensor 8 and the irradiation direction D2 of the light emitting part of the second sensor are arranged to be different and its specific authenticity identification method, and the types and the installation conditions of the light sources to be used may be modified as appropriate. Further, the driving sources that drive various types of driving members installed in the bill processing apparatus or the power transmission mechanism from the driving sources may be appropriately modified.

According to the bill processing apparatus 1 of the above-mentioned embodiment, it is possible to judge the authenticity of the identification object to be conveyed in the traveling route based on the detection results by the first sensor and the second sensor. In this case, since the light emitting part of the first sensor and the light emitting part of the second sensor have different irradiation directions, when the first light receiving part and the second light receiving part receive lights, the light interference is suppressed whereby the identification object can be read accurately.

Further, the apparatus comprises: a traveling route through which the identification object is conveyed, and the traveling route has a first traveling route and a second traveling route inclined at a predetermined angle to the first traveling route, and a first sensor may be installed in the first traveling route and a second sensor may be installed in the second traveling route.

According to such a configuration, since the second traveling route is bent from the first traveling route, by installing the second sensor in the second traveling route, it is possible to easily change the irradiation directions of the first light emitting part of the first sensor and the second light emitting part of the second sensor.

Further, the apparatus comprises: a conveyance mechanism which conveys and moves the identification object, and the control means for controlling the conveyance mechanism, and wherein the second sensor has a function to detect the existence of the identification object in the traveling route while the control means is capable of cancelling and disabling the operation of the conveyance mechanism based on the detection result from the second sensor and the period of time during which the identification object is moved by the conveyance mechanism to pass through the second sensor.

In such a configuration, it is possible to specify the passage time by the second sensor when the identification object is moved and passes through the portion. Once the second sensor detects the existence of the identification object and further the second sensor still detects the existence of the identification object even after the specified passage time, the operation of the conveyance mechanism is cancelled (disabled). Therefore, it is possible to detect jamming of the identification object, or effectively prevent a fraudulent activity such as an activity of drawing out the identification object.

Further, the apparatus comprises: a conveyance mechanism which conveys and moves the identification object, and control means which controls the conveyance mechanism, and wherein the control means is capable of cancelling (disabling) the operation of the conveyance mechanism when the second sensor detects a movement of the identification object supposedly staying at an escrow position, the identification object having been read by the first sensor and stopped thereat.

In such a configuration, after the reading of the identification object is completed by the first sensor, the identification object is conveyed toward the downstream side and then stopped at the escrow position until a predetermined process is completed thereat. In this state, when the second sensor detects a movement of the identification object, it is considered that a fraudulent process such as a drawing out activity is executed, and a process of cancelling (disabling) the operation of the conveyance mechanism is executed. That is, in a state that the identification object is stopped and staying at the escrow position, it is likely that a fraudulent activity may be committed. However, when a movement of the paper sheet is detected at the escrow position by the second sensor, the operation of the conveyance mechanism may be cancelled (disabled) such that it can be reliably prevent such a fraudulent activity.

As described above, the paper sheet processing apparatus capable of accurately reading the identification object may be provided.

The present invention can be incorporated into various types of apparatuses to provide products and services by inserting a bill thereinto, for example.

What is claimed is:

1. A paper sheet processing apparatus comprising:

a traveling route in which an identification object is conveyed, the traveling route including a first portion and a second portion that is connected to, and offset at a predetermined angle from, the first portion;

a first sensor installed along the first portion of the traveling route, the first sensor including a first light emitting part which is disposed on a first side of the traveling route, and which irradiates the identification object with light, and a first light receiving part which is disposed on a second side of the traveling route that is opposite the first side, and which receives light passing through the identification object from the first light emitting part;

a second sensor installed along the second portion of the traveling route, the second sensor including a second light emitting part which is disposed on the first side of the traveling route, and which irradiates light in a different irradiation direction from an irradiation direction of the first light emitting part, and a second light receiving part which is disposed on the first side of the traveling route and in a lateral direction from the second light emitting part, and which receives light reflected from the identification object;

a conveyance mechanism which conveys the identification object;

a movable piece detecting sensor disposed along the traveling route such that the first sensor is arranged between the movable piece detecting sensor and the second sensor, wherein the movable piece detecting sensor (a) detects a trailing end of the identification object as the identification object travels along the traveling route and (b) triggers a process for closing the traveling route when the trailing end is detected; and a control unit which controls the conveyance mechanism, wherein:

the second sensor is configured to detect existence of the identification object in the traveling route, and the control unit is configured to cancel operation of the conveyance mechanism based on a detection result by the second sensor and a period of time during which the identification object is moved by the conveyance mechanism and is passed through the second sensor.

2. The paper sheet processing apparatus according to claim 1, wherein the second sensor comprises a bar code sensor.

3. A paper sheet processing apparatus comprising:

a traveling route in which an identification object is conveyed, the traveling route including a first portion and a second portion that is connected to, and offset at a predetermined angle from, the first portion;

a first sensor installed along the first portion of the traveling route, the first sensor including a first light emitting part which is disposed on a first side of the traveling route, and which irradiates the identification object with light, and a first light receiving part which is disposed on a second side of the traveling route that is opposite the first side, and which receives light passing through the identification object from the first light emitting part;

a second sensor installed along the second portion of the traveling route, the second sensor including a second light emitting part which is disposed on the first side of the traveling route, and which irradiates light in a different irradiation direction from an irradiation direction of the first light emitting part, and a second light receiving part which is disposed on the first side of the traveling route and in a lateral direction from the second light emitting part, and which receives light reflected from the identification object;

a conveyance mechanism which conveys the identification object;

a movable piece detecting sensor disposed along the traveling route such that the first sensor is arranged between the movable piece detecting sensor and the second sensor, wherein the movable piece detecting sensor (a) detects a trailing end of the identification object as the identification object travels along the traveling route and (b) triggers a process for closing the traveling route when the trailing end is detected; and a control unit which controls the conveyance mechanism and which is configured to cancel operation of the conveyance mechanism when the second sensor detects that the identification object is stopped at an escrow position after the identification object is read by the first sensor.

4. The paper sheet processing apparatus according to claim 3, wherein the second sensor comprises a bar code sensor.

5. A paper sheet processing apparatus comprising:

an insertion slot having an opening through which a paper sheet can be inserted;

a first traveling route extending in a substantially straight manner and having height and width in which the paper sheet having been inserted can be conveyed;

a second traveling route extending downstream from the first traveling route, being positioned at an offset angle with respect to the first traveling route, and having height and width in which the paper sheet can be conveyed;

a first sensor including:

a first light emitting part irradiating light to the paper sheet, and being positioned on a first side of the first traveling route, and a first light receiving part receiving light passing through the paper sheet from the first light emitting part, and being positioned on a second side of the first traveling route that is opposite the first side of the first traveling route; and a second sensor including:

a second light emitting part irradiating light to the paper sheet, and being positioned on a selected side of the second traveling route, and a second light receiving part receiving light reflected from the paper sheet, and being positioned on the selected side of the second traveling route in a lateral direction with respect to the second light emitting part.

6. The paper sheet processing apparatus according to claim 5, further comprising:

a conveyance mechanism which conveys the paper sheet; and a control unit which controls the conveyance mechanism, wherein the second sensor detects a start time when light from the second light emitting part becomes reflected on the paper sheet so as to become receivable by the second light receiving part and an end time when light from the second light emitting part is no longer reflected from the paper sheet, and wherein the control unit cancels operation of the conveyance mechanism in response to a kind of the paper sheet based on a time difference between the start time and the end time, and a conveyance speed of the conveyance mechanism.

7. The paper sheet processing apparatus according to claim 6, wherein the second sensor comprises a bar code sensor.

8. The paper sheet processing apparatus according to claim 5, further comprising:

a conveyance mechanism which conveys the paper sheet; and a control unit which controls the conveyance mechanism, wherein the control unit cancels operation of the conveyance mechanism when the second sensor detects that the paper sheet is stopped at an escrow position after the first sensor reads the paper sheet.

9. The paper sheet processing apparatus according to claim 8, further comprising a movable piece detecting sensor disposed such that the first sensor is arranged between the movable piece detecting sensor and the second sensor, wherein the movable piece detecting sensor (a) detects a trailing end of the paper sheet as the paper sheet travels along the traveling route, and (b) triggers a process for closing the traveling route when the trailing end is detected; and wherein the second sensor comprises a bar code sensor.

10. The paper sheet processing apparatus according to claim 5, further comprising a movable piece detecting sensor disposed such that the first sensor is arranged between the movable piece detecting sensor and the second sensor, wherein the movable piece detecting sensor (a) detects a trailing end of the paper sheet as the paper sheet travels along the traveling route, and (b) triggers a process for closing the traveling route when the trailing end is detected; and wherein the second sensor comprises a bar code sensor.

* * * * *